US005802838A

United States Patent [19]

Bock

[11] Patent Number: 5,802,838

[45] Date of Patent: Sep. 8, 1998

[54] COUPLING DEVICE FOR CONNECTING A ROTOR POT TO A ROTOR SHAFT IN AN OPEN-END SPINNING ROTOR

[75] Inventor: Erich Bock, Wettstetten, Germany

[73] Assignee: Rieter Ingolstadt Spinnereimaschinenbau AG, Ingolstadt, Germany

[21] Appl. No.: 840,408

[22] Filed: Jul. 29, 1997

[30] Foreign Application Priority Data

May 25, 1996 [DE] Germany ..... 196 21 190.5

[51] Int. Cl.[6] ..... D01H 4/00

[52] U.S. Cl. ..... 57/406; 57/404; 57/414

[58] Field of Search ..... 57/404, 406, 407, 57/414, 415, 417, 408, 411, 413

[56] References Cited

U.S. PATENT DOCUMENTS

| | | | |
|---|---|---|---|
| 4,319,449 | 3/1982 | Hofmann . | |
| 4,503,663 | 3/1985 | Oexler . | |
| 5,526,638 | 6/1996 | Bock et al. | 57/408 |
| 5,555,715 | 9/1996 | Paweletz et al. . | |
| 5,634,326 | 6/1997 | Wanger . | |
| 5,644,910 | 7/1997 | Ball et al. . | |

FOREIGN PATENT DOCUMENTS

| | | | |
|---|---|---|---|
| 3815182 | 11/1989 | Germany | 57/414 |
| 3815182A1 | 11/1989 | Germany . | |
| 4009374 | 9/1991 | Germany | 57/414 |
| 4020518 | 1/1992 | Germany | 57/414 |
| 9319151.0 | 4/1994 | Germany . | |
| 4342539A1 | 6/1995 | Germany . | |

OTHER PUBLICATIONS

German Search Report, Sep. 3, 1996.

*Primary Examiner*—William Stryjewski
*Attorney, Agent, or Firm*—Dority & Manning

[57] ABSTRACT

An open-end spinning rotor for a textile machine includes a shaft and a supporting part received on one end of the shaft. A rotor pot is mounted on the shaft and is received by the supporting part. A coupling is operably configured between the rotor pot and the supporting part. The coupling comprises a first part configured on the rotor pot and a second part configured on the supporting part. An elastic element is incorporated with at least one of the first or second parts of the coupling to attenuate oscillations and vibrations which would be transmitted through the coupling.

14 Claims, 1 Drawing Sheet

COUPLING DEVICE FOR CONNECTING A ROTOR POT TO A ROTOR SHAFT IN AN OPEN-END SPINNING ROTOR

BACKGROUND OF THE INVENTION

The present application relates to an open-end spinning rotor. A spinning rotor, the rotor pot of which is connected to the supporting part of the rotor shaft via a coupling arrangement, is known from DE-A 38 15 182. In one embodiment the coupling consists of two elastic hooks which engage an undercut at the rotor pot when the rotor pot and rotor shaft are put together. This undercut is in the form of an inclined surface. During the operation of the spinning rotor, the hooks press upon this inclined surface due to the centrifugal force, causing the pot of the spinning rotor to be pulled in the direction of the supporting part and thereby of the rotor shaft. In another embodiment, the coupling arrangement is essentially attached to the rotor plate. It consists of a locking element which is contained in a bore perpendicular to the rotor axis. When the open-end spinning rotor is stopped, the locking elements are unlocked by a spring. The rotor pot is held by a magnet against the supporting part or rotor shaft. When the open-end spinning rotor is caused to rotate, the locking elements emerge from the bores in which they are located as a result of centrifugal forces and lock the rotor pot and the supporting part which supports it. An open-end spinning rotor in which the rotor pot is attached by a kind of screw connection to a basic body which supports and drives it is known from DE-A 43 42 539.

OBJECTS AND SUMMARY OF THE INVENTION

The prior art embodiments of open-end spinning rotors have the disadvantage that the connection between rotor pot and the supporting part holding it is costly. It is thus a principal object of the present application to avoid the disadvantages of the state of the art and to propose an open-end spinning rotor which is simple in design and low-cost in manufacture and which, at the same time, ensures secure and simple mounting of the rotor pot. Additional objects and advantages of the invention will be set forth in part in the following description, or may be obvious from the description, or may be learned through practice of the invention.

Thanks to the embodiment according to the invention of the proposed open-end spinning rotor, where the coupling is a snap-on connection, the utilization of an elastic element on at least one part of the snap-on connection enables it to possess the necessary deformability for mounting the rotor pot and, at the same time, ensures a secure hold of the snap-on connection. At the same time, it makes it possible for at least part of the snap-on connection to be received by the elastic element itself, and for the coupling to be of simple design and easy to produce. The elastic element at the same time ensures that oscillations which are transmitted by the supporting part to the spinning rotor, or oscillations which are caused by an imbalance of the rotor pot, do not affect any other parts of the open-end spinning rotor with oscillations, or that the oscillations can be attenuated by the elastic element.

The elastic element also has the additional advantage that the centrifugal force produced by the rotation of the spinning rotor in operation ensures that the snap-on connection holds together even more securely. It is a special advantage if at least part of the snap-on connection surrounds the elastic element in the form of a ring. This makes it possible to attach it securely over a large surface on the elastic element. This can be done, e.g., by bonding or already when forming the elastic element. It is especially advantageous for part of the snap-on connection to surround the elastic element in the form of a ring if said ring is slit. This increases its deformability so that the rotor pot can more easily be connected to the supporting part. It is especially advantageous here if several slits are provided. The part of the snap-on connection attached to the rotor pot is made especially advantageously in the form of an annular groove which can be ground easily into the rotor pot, e.g. by metal cutting.

Making the supporting part in the form of a groove represents another advantageous embodiment of the invention. The supporting part can then very easily be pressed on a rotor shaft for example. Thereby, the part of the coupling which is not on the rotor pot can advantageously be made separately and can then be pressed on the part of the open-end spinning rotor, for example, which ensures support and drive. This may be, e.g., a rotor shaft or advantageously also part of an electric bearing and drive rotor. The supporting part is advantageously made with a stop against which the rotor pot bears axially. This ensures that the rotor plate can be connected in exact position with the supporting part. Dimensional deviations which may occur in the area of the snap-on connection can be compensated for through this. For this purpose, the rotor pot has an opposing surface which interacts with the stop of the supporting part. By making the elastic element of synthetic material it can be produced easily and inexpensively. It is also easy to connect it to the supporting part of e.g. also with the rotor plate. Furthermore, synthetic material has the advantage of having an especially good attenuating effect. Elastomer is especially well suited as the synthetic material to be used. In another advantageous embodiment of the snap-on connection, at least part of it is made of an aluminum alloy. This makes it possible to produce it in a simple operational step. It is especially advantageous to make it as an extruded part because it can thus be produced with precision in form and rapidly. In an especially advantageous further development of the invention, the coupling connects rotor pot and rotor shaft or a supporting part of the rotor pot of different design interlockingly in the circumferential direction. This ensures advantageously that no relative movement between rotor shaft and rotor pot occurs in circumferential direction. This is especially important for the acceleration of the spinning rotor and for braking it to stoppage.

The invention is described below through drawings.

DETAILED DESCRIPTION OF THE DRAWINGS

Figure 1:
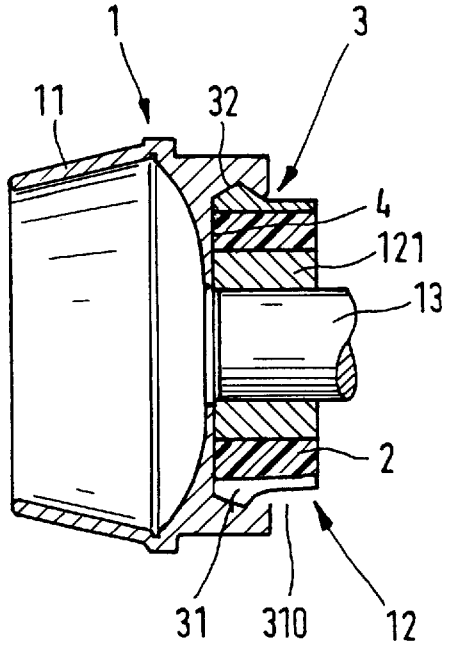
FIG. 1 shows a section through an open-end spinning rotor made according to the invention.

Reference will now be made in detail to the presently preferred embodiments of the invention, one or more examples of which are illustrated in the drawings. Each example is provided by way of explanation of the invention, and not as a limitation of the invention. In fact, various modifications and variations can be made in the present invention without departing from the scope and spirit of the invention. For instance, features illustrated or described as part of one embodiment can be used on another embodiment to yield still a further embodiment. It intended that the present invention cover such modifications and variations as come within the scope of the appended claims and their equivalents.

The open-end spinning rotor 1 of FIG. 1 consists of a rotor pot 11, a supporting part 12 and a shaft 13 via which the open-end spinning rotor 1 is supported e.g. on bearing disks and is driven e.g. via a tangential belt in a known manner. The supporting part 12 consists of a hub 121 which is pressed on the shaft 13 by means of a snap-on connection. This hub 121 supports an elastic element 2 on its outer circumference. It is firmly connected to the hub 121 by means of bonding, for example. The elastic element 2 may be made of synthetic material or rubber. On its outer circumference the elastic element 2 supports part of the coupling 3 through which the rotor pot 11 is connected to the supporting part 12. The coupling 3 consists here of the nose 31 which interacts with a circumferential groove 32 on the rotor pot 11. The coupling 3 is made in the form of a snap-on connection so that the attachment of the rotor pot 11 on the supporting part 12 is possible by simply pushing the two components together. Due to the fact that the nose 31 is on the elastic element 2, said nose 31 is able to escape in the direction of the shaft 13 when the supporting part and the rotor pot are joined together, so that the edge of the circumferential groove 32 can be pushed over the nose 31, so that an interlocking connection between nose 31 and circumferential groove 32 results. The nose 31 is part of a ring-shaped element 310 which is firmly connected to the elastic element 2 in the same manner as the hub 121. The ring-shaped element 310 may be provided with one or several slits in longitudinal direction of the shaft 13 so that greater elasticity of the ring-shaped element results when rotor pot and supporting part are joined together. The slits may go all the way through the ring-shaped element 310, as can be seen in the lower half of FIG. 1 from the missing hatch marks. The slit may however also be made only in part of the nose 31 of the ring-shaped element 310. The ring-shaped element 310 may be made of steel, for example, while the rotor pot 11 may be made of aluminum. It surrounds the elastic element 2 at its outer circumference. The slit serves furthermore at the same time as an anti-rotation device in circumferential direction between the rotor pot 11 and the shaft 13. For this, the nose 31 bears in circumferential direction upon a stop of the rotor pot 11 which is not shown here. In order to form this stop, the circumferential groove 32 may be discontinuous, for example, so that a ridge extending in the axial direction is left standing. The same effect, e.g. the prevention of rotation, can also be obtained by means of axially extending pins for example, which engage in part the rotor pot 11 and e.g. the rotor shaft 13 or the hub 121.

During the operation of the open-end spinning rotor 1 the latter is caused to rotate around its rotational axis which is the rotational axis of shaft 13, with rotational speeds up to 150,000 RPM are absolutely possible. At the same time, due to the centrifugal forces acting upon the coupling 3, the ring-shaped element 310 expands since the elastic element 2 yields to the centrifugal forces. This ensures an especially good connection between the nose 31 and the circumferential groove 32. At the same time however, the connection between ring-shaped element 310 via elastic element 2 and hub 121 provides a connection which can easily be disconnected when the spinning rotor 1 is stopped.

Figure 2:
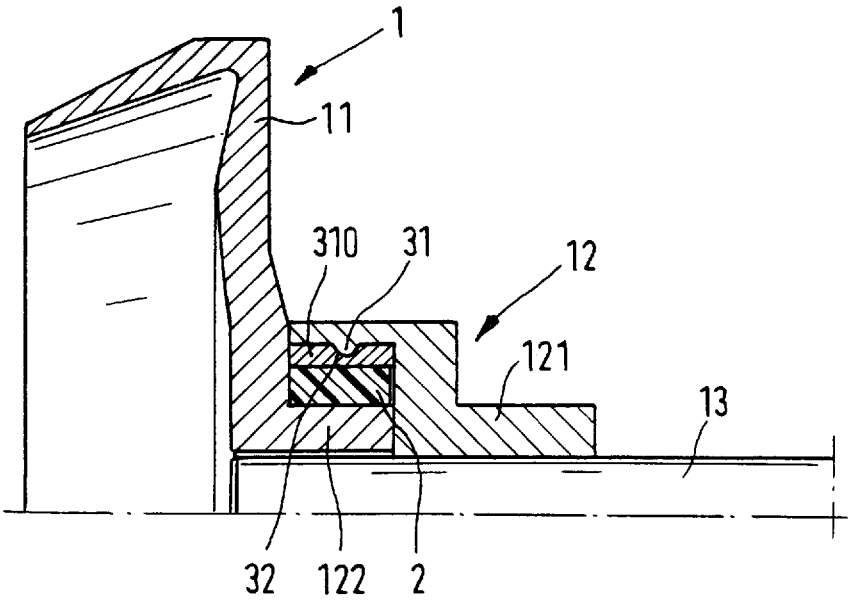
FIG. 2 shows a section through part of an open-end spinning rotor made according to the invention.

FIG. 2 also shows an open-end spinning rotor according to the invention in a section and only in part. The elastic element 2 is here attached to a hub-shaped projection 122 of the rotor pot 11. The ring-shaped element 310 of the coupling 3 is located on the elastic element 2. In FIG. 2 the ring-shaped element 310 is provided with a circumferential groove 32 which interacts with a nose 31. The nose 31 in the embodiment of FIG. 2 is part of the hub 121. The supporting part 12 is connected as in FIG. 1 to a shaft 13 on which the open-end spinning rotor 1 is supported in a known manner via bearing disks. However the supporting part 12 can just as well be connected to a bearing and drive element as shown in DE-A 43 42 539.

It should be apparent to those skilled in the art that various modifications and variations can be made in the present invention without departing from the scope and spirit of the invention. The present invention covers such modifications and variations as come within the scope of the appended claims and their equivalents.

I claim:

1. An open end spinning rotor for a textile spinning machine, said rotor comprising:

a shaft;

a supporting part received in part on one end of said shaft;

a rotor pot mounted on said shaft and received by said supporting part;

said supporting part further comprising a coupling having a first axially extending projection configured on said rotor pot and a second axially extending projection configured on said shaft and concentric with said first axially extending projection; and an elastic element disposed between and concentric with said first and said second axially extending projections of said coupling so as to attenuate oscillations and vibrations transmitted through said coupling.

2. The rotor as in claim 1, wherein said supporting part further comprises a ring shaped element attached to an outer circumferential surface of said elastic element.

3. The rotor as in claim 2, wherein said ring shaped element is slotted to increase its deformability.

4. The rotor as in claim 1, wherein said first axially extending portion comprises a circumferential groove defined in said rotor pot for connecting said rotor pot with said supporting element.

5. The rotor as in claim 1, wherein said second axially extending portions comprises a hub.

6. The rotor as in claim 5, wherein said hub is press fitted onto said shaft.

7. The rotor as in claim 6, wherein said elastic element is connected to and surrounds at least part of said hub.

8. The rotor as in claim 1, wherein said supporting part further defines a stop for said rotor pot.

9. The rotor as in claim 8, wherein said elastic element forms part of said stop.

10. The rotor as in claim 1, wherein said elastic element is formed of one of a synthetic or elastomer material.

11. The rotor as in claim 1, wherein said coupling connects said rotor pot and said supporting element interlockingly in an circumferential direction.

12. The rotor as in claim 1, wherein said second axially extending portion is concentric within said first axially extending portion.

13. The rotor as in claim 1, wherein said first axially extending portion is concentric within said second axially extending portion.

14. The rotor as in claim 1, wherein said first axially extending portion comprises an integral portion of said rotor pot.

* * * * *